United States Patent [19]

Mizushima et al.

[11] Patent Number: 5,047,266

[45] Date of Patent: Sep. 10, 1991

[54] PROCESS FOR PRODUCING SYNTHETIC FIBER AND VEGETABLE FIBER BY FIBROIN PROTEIN WITH EGG WHITE AND ACRYLIC RESIN

[75] Inventors: Shigesaburo Mizushima, No. 98-11, Notobeshimo, Rokusei-machi, Kashima-gun, Ishikawa-ken; Shigemi Mizushima, No. 81-17, 3-chome, Akayama-cho, Koshigaya-shi, Saitama-ken, both of Japan

[73] Assignees: Shigesaburo Mizushima, Ishkawa; Shigemi Mizushima, Saitama; Mizushima Silk Industries Co., Ltd., Ishikawa, all of Japan

[21] Appl. No.: 500,255

[22] Filed: Mar. 27, 1990

[30] Foreign Application Priority Data

Apr. 17, 1989 [JP] Japan ..... 1-96937

[51] Int. Cl.[5] ..... B05D 3/04

[52] U.S. Cl. ..... 427/338; 427/170; 427/377; 427/393.1

[58] Field of Search ..... 427/170, 393.1, 338, 427/414, 200, 377

[56] References Cited

U.S. PATENT DOCUMENTS

| | | | |
|---|---|---|---|
| 167,521 | 9/1875 | Frash | 427/338 |
| 294,731 | 3/1884 | Garnier et al. | 427/338 |
| 643,923 | 2/1900 | Ungnad | 427/338 |
| 1,945,449 | 5/1933 | Redman | 427/338 |
| 1,988,375 | 1/1935 | Davis | 427/140 |
| 4,167,045 | 9/1979 | Sawyer | 427/430.1 |
| 4,265,233 | 5/1981 | Sugitachi et al. | 128/156 |
| 4,695,484 | 9/1987 | Tanaka et al. | 427/338 |
| 4,766,005 | 8/1988 | Montgomery et al. | 427/4 |

FOREIGN PATENT DOCUMENTS

| | | | |
|---|---|---|---|
| 66 | of 1866 | United Kingdom | 427/338 |

*Primary Examiner*—Michael Lusignan
*Assistant Examiner*—Diana L. Dudash
*Attorney, Agent, or Firm*—Wenderoth, Lind & Ponack

[57] ABSTRACT

The present invention provides a processing method for producing synthetic fiber and vegetable fiber, by which it is possible to add soft feeling of silk to synthetic fiber and vegetable fiber and a new type of fiber can be produced, which is provided with the advantages of both synthetic fiber or vegetable fiber and silk and can be used as the fiber for clothings and also as industrial materials.

3 Claims, 1 Drawing Sheet

PROCESS FOR PRODUCING SYNTHETIC FIBER AND VEGETABLE FIBER BY FIBROIN PROTEIN WITH EGG WHITE AND ACRYLIC RESIN

BACKGROUND OF THE INVENTION

The present invention relates to a process for producing synthetic fiber and vegetable fiber by fibroin protein, and more particularly, to a process for producing synthetic fiber and vegetable fiber by fibroin protein, by which a new type fiber having the advantages of both synthetic fiber or vegetable fiber and silk can be obtained.

In general, synthetic fiber is superior to silk or vegetable fiber in tensile strength and abrasion resistance, while it is inferior in feeling and it generates more static electricity. Thus, it has been rarely used alone without processing, and its application has been limited.

Vegetable fiber is fluffy and lacks soft feeling of silk because it is made of short fibers.

Under such circumstances, composite fiber consisting of synthetic fiber with silk filaments wound on outer periphery has been invented for the purpose of providing both the strength of synthetic fiber and the soft feeling of silk.

SUMMARY OF THE INVENTION

However, in the composite fiber as described above, consisting of synthetic fiber with silk filaments, synthetic fiber and silk filaments are not perfectly bonded together. Accordingly, it is difficult to maintain homogeneous quality because silk filaments lack the strength and are often broken in the middle.

The object of the present invention is to provide synthetic fiber and vegetable fiber with homogeneous quality and soft feeling of silk and to offer a new type of fiber, which has the advantages of both synthetic fiber and vegetable fiber and can be used not only for clothings but also for industrial materials.

DETAILED DESCRIPTION OF THE INVENTION

Figure 1:
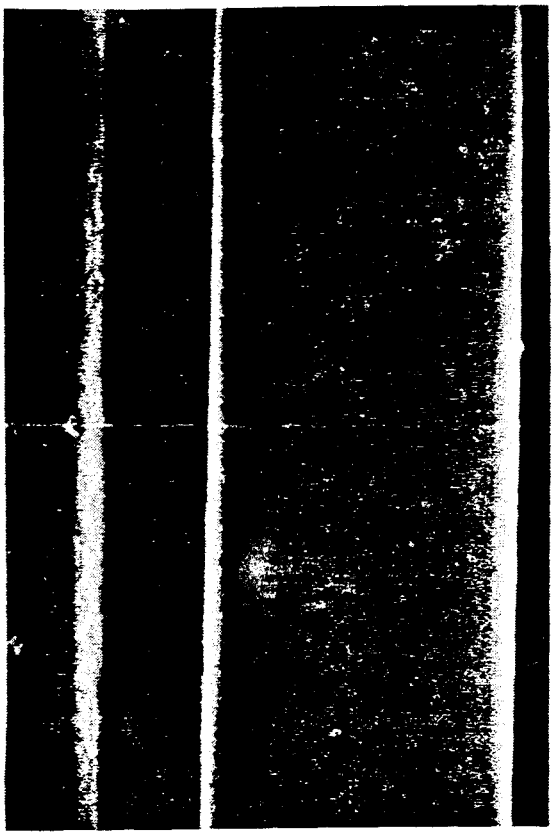
FIG. 1 is a photographic representation of nylon yarn before being processed by fibroin protein according to the present invention.
Figure 2:
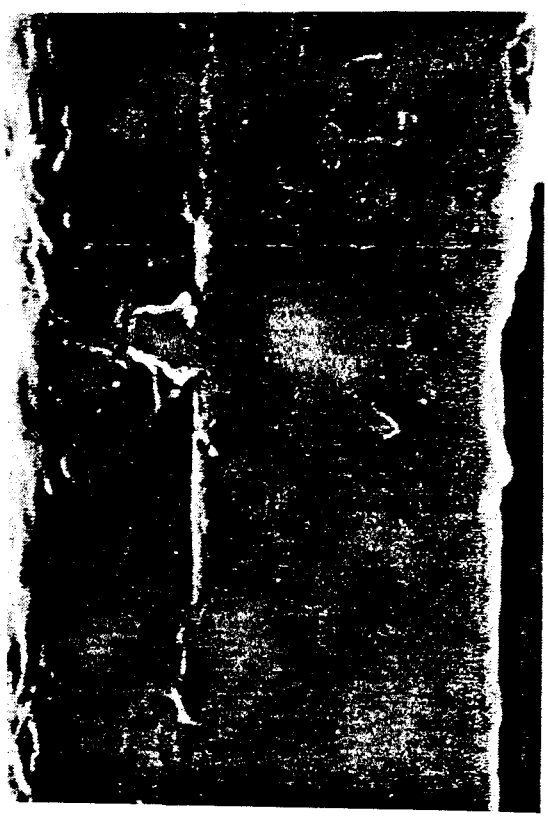
FIG. 2 is a photograph of nylon yarn, which has been processed by fibroin protein according to this invention.

To produce fibroin protein solution, a method is generally known, by which the refined silk is dissolved in calcium chloride and ethanol or in lithium bromide and ethanol, and fibroin protein solution is produced by desalinization through electrodialysis using ion exchange membrane.

If the fibroin protein thus obtained can be fixed on various types of fiber, it is possible to produce the fiber with the soft feeling of silk. However, because fibroin protein has low adhesive property, it cannot be adhered to fiber without additional processing.

To attain this purpose, one liter of acrylic resin solution of about 30% volume concentration is added to the solution containing 1 kg of egg-white and 3 liters of water. This mixture solution is adsorbed on synthetic fiber yarn or vegetable fiber yarn by one thread sizing method and is dried. Then, fibroin protein solution of 10% weight concentration is adsorbed on this synthetic fiber yarn or vegetable fiber yarn by one thread sizing method and is dried. Then, steam setting is performed at 80° to 100° C. for 20 to 30 minutes. Further, this yarn is immersed in ethanol solution with 70 to 80% volume concentration at 60° to 70° C. for 20 to 30 minutes or in acetic acid or hydrochloric acid of 5% volume concentration at 20° to 30° C. for 20 to 60 minutes.

Through this processing, acrylic resin is adsorbed on synthetic fiber yarn or vegetable fiber yarn together with egg-white. When this is dried, acrylic resin becomes insoluble, and fibroin protein is bonded with egg-white. Through the steam setting, egg-white is turned insoluble or the fibroin protein bonded with egg-white becomes insoluble by ethanol processing or acid processing. Thus the silk protein fibroin can be fixed stably on synthetic fiber yarn or vegetable fiber yarn, and this may be called "silk-plating".

Next, one liter of acrylic resin solution of about 30% volume concentration is added to the solution containing 1 kg of egg-white and 3 liters of water. This mixture solution is adsorbed on synthetic fiber textile or vegetable fiber textile by mangle system and is dried. After fibroin protein solution of 10% weight concentration is adsorbed on synthetic fiber textile or on vegetable fiber textile by mangle system and is dried, steam setting is performed at 80° to 100° C. for 20 to 30 minutes. Then, ethanol processing or acid processing is performed as in the Embodiment 1. Thus, synthetic fiber textile and vegetable fiber textile can be processed by silk-plating.

As described above, when synthetic fiber yarn is processed by the processing method with fibroin protein according to this invention, the disadvantages peculiar to synthetic fiber can be eliminated and favorable feeling can be provided. Yarn is swollen and the generated static electricity is reduced from 8000 V to 1000 V. The yarn has soft feeling because its swelling property is twice as high as that of silk even when it has same fineness as silk fiber. Because it has high strength of synthetic fiber yarn, textile or knitwork with excellent quality and property can be offered.

When the processing method according to the present invention is applied on vegetable fiber, the disadvantage of short fiber, i.e. fluffiness, disappears. Because fibers are turned to monofilaments without being separated and give favorable feeling similar to that of long fibers, this gives voluminous feeling to textile or knitwork.

Further, if the processing method according to this invention is applied on synthetic fiber textile and vegetable fiber textile, acrylic resin and fibroin protein enter into the weavings and are fixed there, filling the gaps and providing waterproofness. Thus, the fiber can be used in wide application and industrial materials in addition to the application in textile.

What is claimed is:

1. A process for producing a synthetic fiber and vegetable fiber by use of fibroin protein, which comprises adsorbing a solution containing egg-white and acrylic resin onto a synthetic fiber yarn or vegetable fiber yarn and drying the resulting fiber, adsorbing fibroin protein onto said synthetic fiber yarn or vegetable yarn, fixing said fibroin protein on said synthetic fiber yarn or vegetable fiber yarn by converting said fibroin protein and egg-white, which were adsorbed in synthetic fiber yarn or vegetable fiber yarn, to an insoluble state.

2. A process for producing a synthetic fiber and vegetable fiber by use of fibroin protein, which comprises adsorbing a solution containing egg-white and acrylic resin onto synthetic fiber textile or vegetable fiber textile and drying the resulting fiber, adsorbing fibroin protein onto said synthetic fiber textile or vegetable fiber textile, and fixing said fibroin protein onto said synthetic fiber textile or vegetable fiber textile by converting said fibroin protein and egg-white, which were adsorbed in synthetic fiber yarn or vegetable fiber yarn, to an insoluble state.

3. A process according to claim 1 or 2 wherein said egg-white adsorbed in synthetic fiber or vegetable fiber is process to an insoluble state by steam setting, and said fibroin protein adsorbed in synthetic fiber or vegetable fiber is processed to an insoluble state by use of ethanol or an acid.

* * * * *